US005946019A

United States Patent [19]

Suzuki et al.

[11] Patent Number: 5,946,019

[45] Date of Patent: Aug. 31, 1999

[54] RECORDING METHOD AND APPARATUS FOR POSITIVELY ERASING AN IMAGE RECORDED ON A REVERSIBLE HEAT-SENSITIVE RECORDING MEDIUM

[75] Inventors: Akira Suzuki; Fumihito Masubuchi, both of Shizuoka, Japan

[73] Assignee: Ricoh Company, Ltd., Tokyo, Japan

[21] Appl. No.: 08/992,175

[22] Filed: Dec. 17, 1997

[51] Int. Cl.[6] ..... B41M 5/26; B41M 5/36; B41J 2/32

[52] U.S. Cl. ..... 347/171

[58] Field of Search ..... 347/171; 400/120.01

[56] References Cited

U.S. PATENT DOCUMENTS 5,231,505 7/1993 Watanabe et al. ..... 347/171

FOREIGN PATENT DOCUMENTS 4-44887 2/1992 Japan .

5-04446 1/1993 Japan .

9-141907 6/1997 Japan .

*Primary Examiner*—Huan Tran

*Attorney, Agent, or Firm*—Oblon, Spivak, McClelland, Maier & Neustadt, P.C.

[57] ABSTRACT

A recording and erasure of a visible image on a reversible heat-sensitive recording medium can be repeatedly performed in a stable condition without failure. The visible image is recorded by a thermal recording head on a display area of the recording medium. The recording medium has a non-display area other than the display area. The visible image is erased by providing heat from a thermal erasing head. The thermal erasing head contacts the non-display area before the thermal erasing head contacts the display area so that dirt adhering on the thermal erasing head is removed by friction between the thermal erasing head and the non-contact area of the recording medium.

17 Claims, 8 Drawing Sheets

BACKGROUND ART

BACKGROUND ART

BACKGROUND ART

RECORDING METHOD AND APPARATUS FOR POSITIVELY ERASING AN IMAGE RECORDED ON A REVERSIBLE HEAT-SENSITIVE RECORDING MEDIUM

BACKGROUND OF THE INVENTION

1. Field of the Invention

The present invention relates to a recording method for recording and erasing an image on a reversible heat-sensitive recording medium and a recording apparatus using such a recording method and, more particularly, to a technique for preventing occurrence of an incomplete erasion when a recording and erasure are repeated.

2. Description of the Related Art

In recent years, a reversible heat-sensitive recording medium has come into widespread use for displaying various kinds of information. Such a reversible heat-sensitive recording medium is disclosed, for example, in Japanese Laid-Open Patent Application No.4-44887. The reversible heat-sensitive recording medium can be used for repeatedly recording and erasing an image by using a material having a characteristic in which a transparency is reversibly changed by changing a temperature of the material.

FIG. 1 shows a structure of a reversible heat-sensitive recording medium using the above-mentioned material. In FIG. 1, the reversible heat-sensitive recording medium 1 comprises a base film 31 made of a polyester film, a recording layer 34 applied on the base film 31 and an over-coating layer 35 protecting the recording layer 34. The recording layer 34 is made of a high polymer/low polymer composite type recording material which comprises a high polymer material 32 and an organic low-molecular material 33 dispersed in the high polymer material 32.

FIG. 2 is a graph showing a temperature-transparency characteristic of a reversible heat-sensitive recording medium. The recording material of the recording layer 34 has a transparency which varies when it is heated or cooled as shown in FIG. 2. Specifically, when the recoding material is at a room temperature below a temperature T1, the recording material is in a white, opaque-like state. This state is referred to as a state A which is a maximum white state. When the recording material is heated from room temperature, the transparency of the recording material starts to increase at a temperature T2, and the transparency becomes maximum at a temperature T3. This state is referred to as a state B which is a maximum transparency state. The maximum transparency is maintained even when the recording material in the maximum transparency state B is cooled to room temperature. This state is referred to as a state C. Then, when the recording material in the state C in which the recoding material has maximum transparency at room temperature is heated again to a temperature T4 which is higher than the temperature T3 as indicated by a dashed line in FIG. 2, the transparency of the recording material assumes a state which is intermediate the maximum transparency state and the maximum white, opaque state. This state is referred to as a state D. When the recording material in the state D is cooled to the state A which is at room temperature T1, the recording material returns to the maximum white, opaque-like state.

The above-mentioned phenomenon occurs when the organic low-molecular material 33 reversibly changes from a poly-crystalline state to a single-crystalline state due to temperature change which results in changes in the transparency of the recording layer 34. Thus, the reversible heat-sensitive recording medium 1 can be repeatedly used for recording and erasing an image thereon.

Japanese Laid-Open Patent Application No.5-4446 discloses a recording apparatus which repeats recording and erasure of an image on the reversible heat-sensitive recording medium 1. This recording apparatus comprises a thermal recording head 5 and a thermal erasing head 6 as shown in FIG. 3. The reversible heat-sensitive recording medium 1 is conveyed by feed rollers 3 and platen rollers 4. The reversible heat-sensitive recording medium 1 being conveyed by the feed rollers 3 and the platen rollers 4 is detected by a position detecting sensor 36 which is located before the thermal erasing head 6. When the reversible heat-sensitive recording medium 1 is detected by the position detecting sensor 36, a temperature of the thermal erasing head 6 is rapidly increased to an erasing temperature at which the reversible heat-sensitive recoding medium 1 is changed to a transparent state before the reversible heat-sensitive recording medium 1 reaches the thermal erasing head 6. After the thermal erasing head 6 reaches the erasing temperature, a pulsed current is supplied to the thermal erasing head 6 so as to maintain the erasing temperature. Thus, the recording layer of the reversible heat-sensitive recording medium 1 is changed to a transparent state so as to erase a visible image formed by in the white state. Thereafter, a new visible image is formed on the reversible heat-sensitive recording medium 1 by the thermal recording head 5. The reversible heat-sensitive recording medium 1 can be used many times by repeating the above-mentioned operation. Since the thermal erasing head 6 has a small heat capacity, the thermal erasing head 6 can be rapidly heated after the reversible heat-sensitive recording medium 1 which is conveyed by the feed rollers 3 is detected by the position detecting sensor 36. Thereby, a visible image erasing unit of the recording apparatus can be miniaturized and energy used by the visible image erasing unit can be saved.

In an erasing operation performed by the thermal erasing head 6, the thermal erasing head 6 is moved while it is in contact with a surface of the reversible heat-sensitive recording medium 1. Accordingly, dirt such as a foreign material or a finger print which adheres on the surface of the reversible heat-sensitive recording medium 1 is transferred to a surface of the thermal erasing head 6. If such dirt adheres on the surface of the thermal erasing head 6, a thermal resistance between the thermal erasing head 6 and the reversible heat-sensitive recording medium 1 is increased. Thus, an amount of heat provided to the reversible heat-sensitive recording medium 1 is decreased which results in a locally incomplete erasure. In such condition, there is a problem in that a new visible image cannot be accurately recorded.

SUMMARY OF THE INVENTION

It is a general object of the present invention to provide an improved and useful recording method and apparatus in which the above-mentioned problem is eliminated.

A more specific object of the present invention is to provide a recoding method and apparatus in which recording and erasure of an image on a reversible heat-sensitive recording medium can be repeatedly performed in a stable condition without failure.

In order to achieve the above-mentioned objects, according to the present invention, a heated area selecting means and a heating head driving means are provided to a recording apparatus which repeatedly performs a recording operation and erasing operation for a visible image on a reversible heat-sensitive recording medium. The reversible heat-sensitive recording medium has a display area on which the visible image is formed and a printed area on which a print is previously provided. The heated area selecting means selects a heated area to be heated which includes a predetermined area of the printed area when a previously visible image recorded on the display area of the reversible heat-sensitive recording medium is erased so as to record a new visible image. A thermal erasing head contacts the selected heated area so that the thermal erasing head contacts the printed area which has a surface roughness greater than that of the display area before the thermal erasing head contacts the display area. That is, the thermal erasing head contacts the display area after dust and dirt adhering on the thermal erasing head is removed by friction between the thermal erasing head and the printed area so as to reduce heat resistance between the thermal erasing head and the display area. Accordingly, the display area can be heated uniformly.

A temperature of the thermal erasing head in contact with the printed area may be set to a temperature lower than a temperature of the thermal erasing head which makes contact with the display area so that dirt or dust is prevented from adhering by heat on the thermal erasing head to facilitate a removal of the dirt or dust.

A distance in which the thermal erasing head contacts the printed area may be set to more than 5 mm so as to increase efficiency in removal of the dirt or dust adhering on the thermal erasing head so that the number of times a positive erasure can be made is increased.

Additionally, a surface roughness of the printed area may be set to 2 $\mu mR_{max}$ or greater so as to positively remove dirt and dust adhering on the thermal erasing head. Further, the surface roughness of the thermal erasing head may be set to 15 $\mu mR_{max}$ or less so as to prevent abrasion of the surface of the thermal erasing head and the thermal recording head.

It should be noted that the present invention can also be applied to an erasing method and apparatus for simply erasing a visible image recorded on the reversible heat-sensitive recording medium.

Other objects, features and advantages of the present invention will become more apparent from the following detailed description when read in conjunction with accompanying drawings.

DETAILED DESCRIPTION OF THE PREFERRED EMBODIMENT

Figure 3:
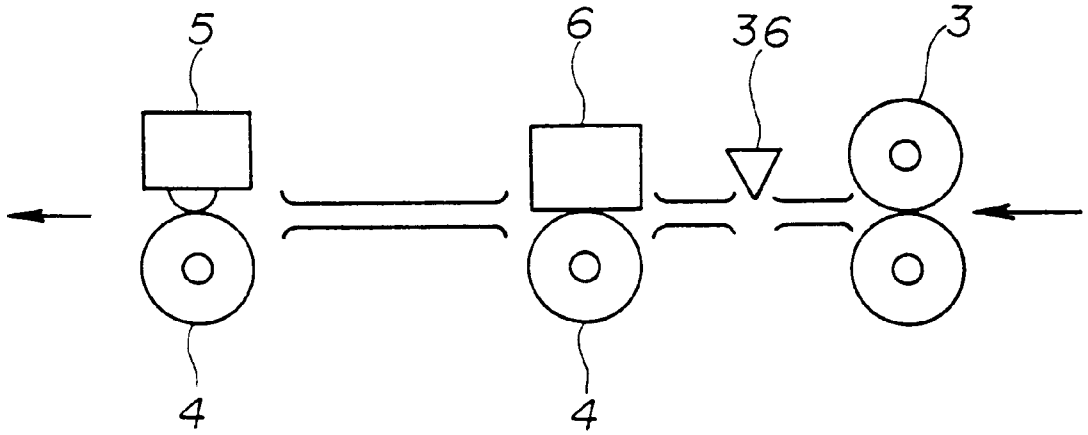
FIG. 3 is an illustration of a structure of a conventional recording apparatus for recording an image on the reversible heat-sensitive recording medium.
Figure 4:
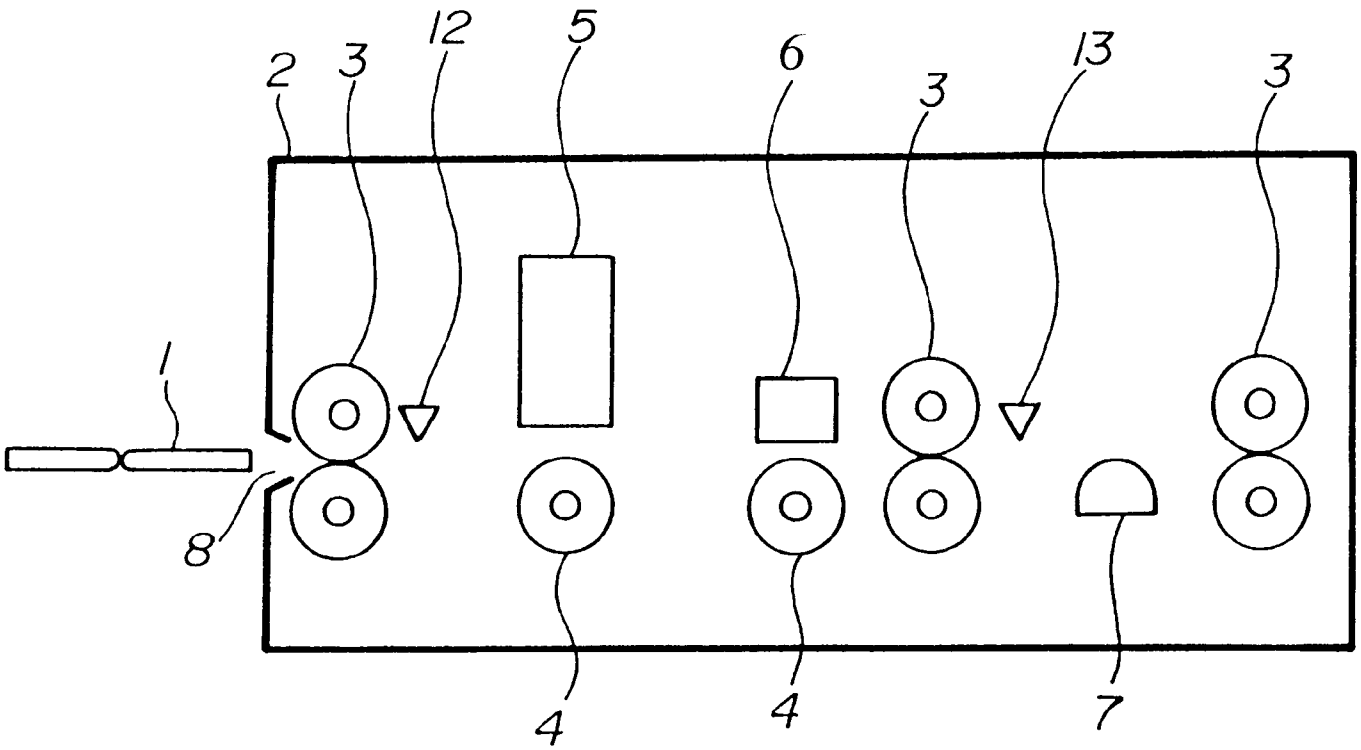
FIG. 4 is an illustration of a recording apparatus according to a first embodiment of the present invention.

A description will now be given of a first embodiment of the present invention. FIG. 4 is an illustration of a recording apparatus according to the first embodiment of the present invention. In FIG. 4, parts that are the same as the parts shown in FIG. 3 are given the same reference numerals.

The recording apparatus 2 shown in FIG. 4 records a visible image on the reversible heat-sensitive recording medium 1 and also erases the visible image recorded on the reversible heat-sensitive recording medium 1. The recording apparatus 2 comprises, as shown in FIG. 4, a plurality of feed rollers 3, a plurality of platen rollers 4, a thermal recording head 5, a thermal erasing head 6 and a magnetic head 7. The thermal recording head 5, the thermal erasing head 6 and the magnetic head 7 are arranged in that order along a conveying path of the reversible heat-sensitive recording medium 1 from a recording medium insertion opening 8.

Figure 5:
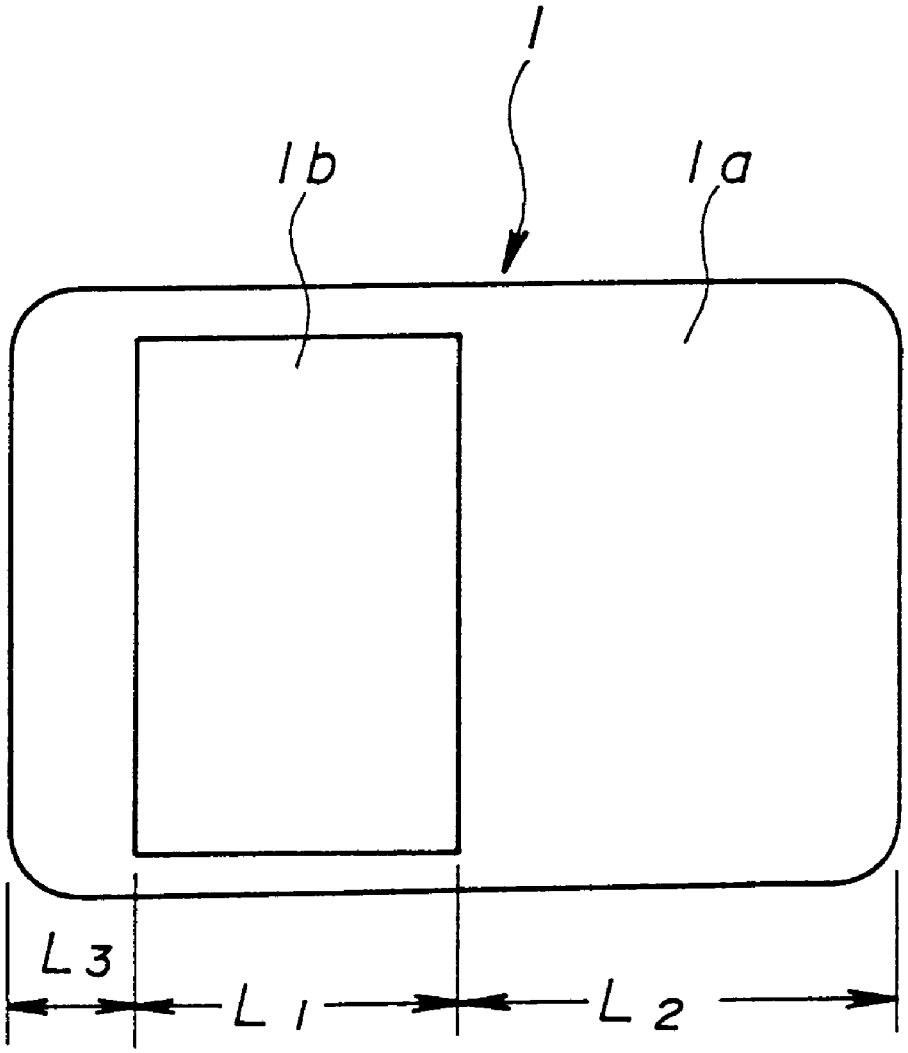
FIG. 5 is a plan view of the reversible heat-sensitive recording medium.

FIG. 5 is a plan view of the reversible heat-sensitive recording medium 1. The reversible heat-sensitive recording medium 1 comprises a printed area 1*a* and a display area 1*b* surrounded by the printed area 1*a* as shown in FIG. 5. Various information can be previously printed on the printed area 1*a*, and a visible image is recorded and displayed on the display area 1*b*.

Figure 1:
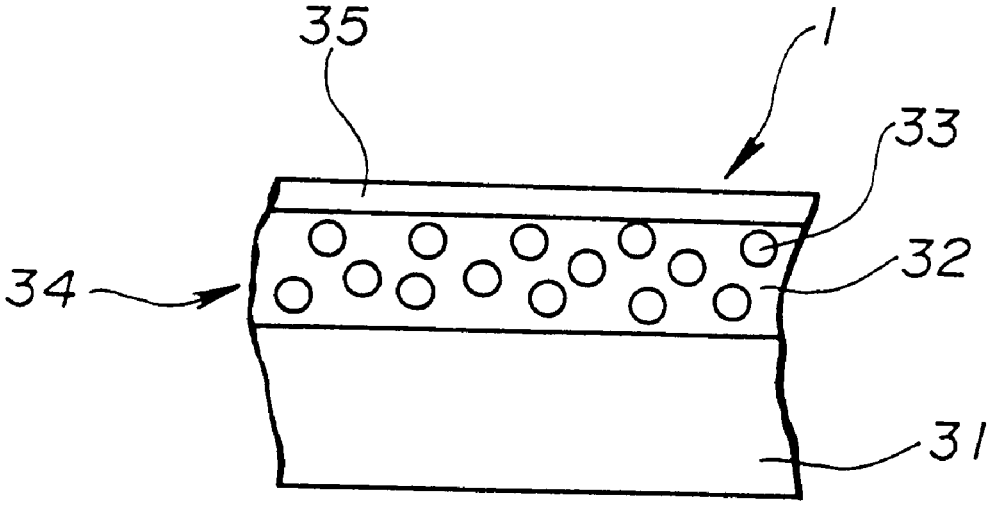
FIG. 1 is a cross-sectional view of a part of a reversible heat-sensitive recording medium.
Figure 2:
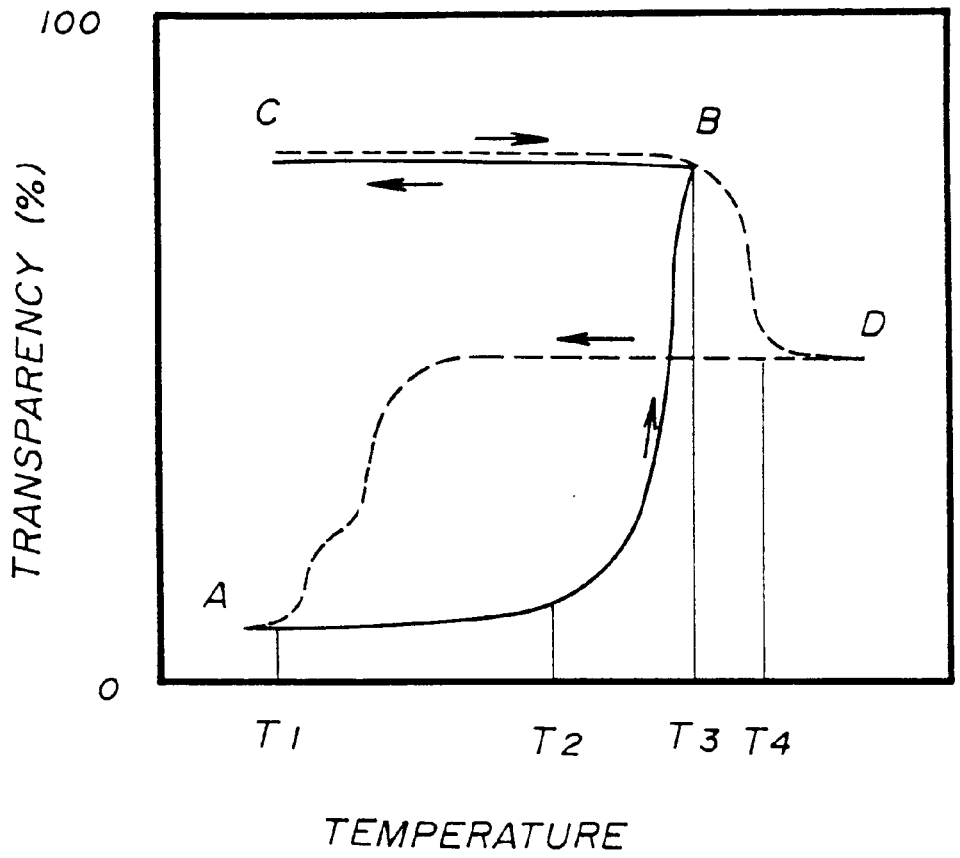
FIG. 2 is a graph showing a temperature-transparency characteristic of the reversible heat-sensitive recording medium.

As described with reference to FIG. 1, the reversible heat-sensitive recording medium 1 comprises the base film 31 made of a polyester film, the recording layer 34 applied on the base film 31 and the over coating layer 35 protecting the recording layer 34. The recording layer 34 is made of a high polymer/low polymer composite type recording material which comprises a high polymer material 32 and an organic low-molecular material 33 dispersed in the high polymer material 32.

Figure 6:
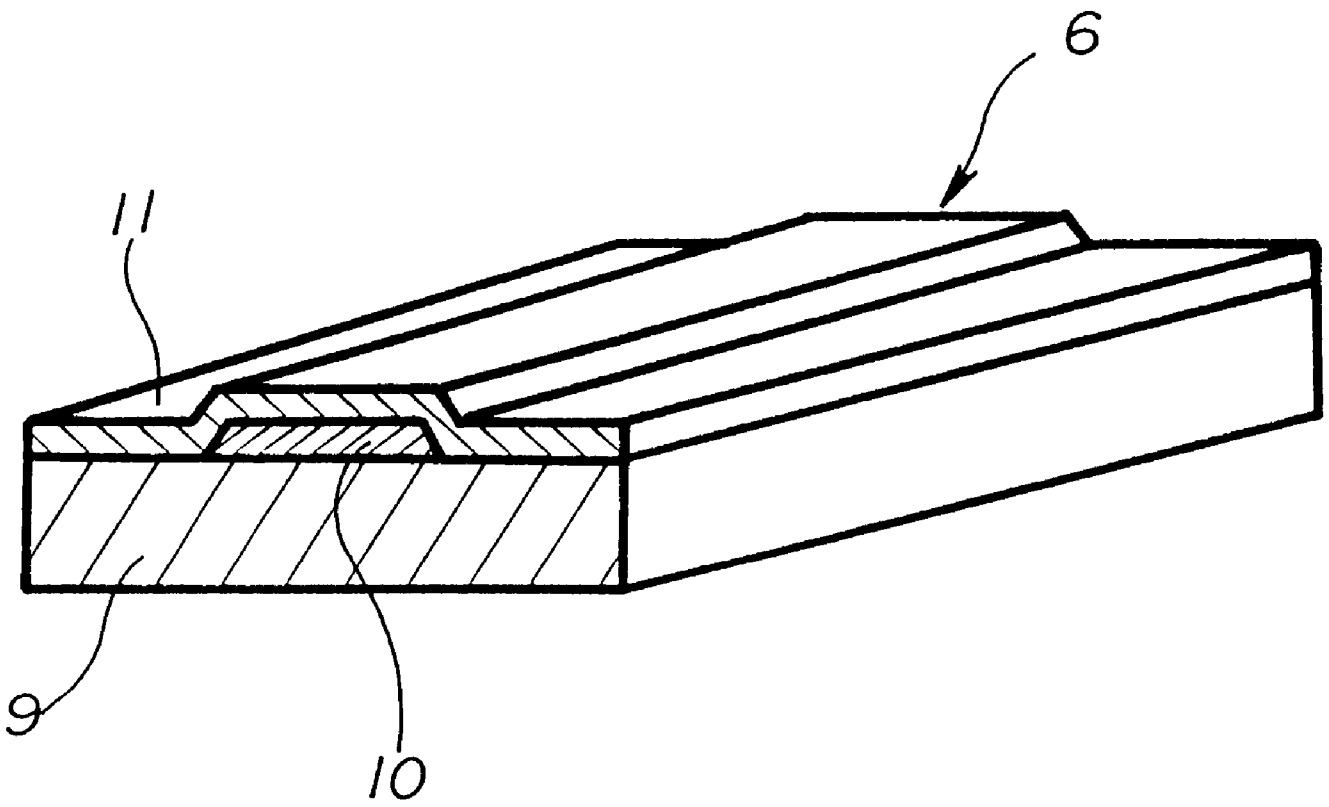
FIG. 6 is a perspective view of a thermal erasing head shown in FIG. 4.

The thermal recording head 5 shown in FIG. 4 records a visible image on the reversible heat-sensitive recording medium 1. The thermal erasing head 6 erases a visible image recorded on the display area 1*b* of the reversible heat-sensitive recording medium 1 by providing heat to the display area 1*b*. FIG. 6 is a perspective view of the thermal erasing head 6. As shown in FIG. 6, the thermal erasing head 6 comprises a ceramic substrate 9 having a thickness of 1 mm, a film-like heat generating resistor member 10 formed on the ceramic substrate 9 and a protective film 11 covering the resistor member 10. In this embodiment, the resistor member 10 has a thickness of 2 $\mu$m and a width of 2 mm. A longitudinal direction of the resistor member 10 is perpendicular to an extending direction of the conveying path of the reversible heat-sensitive recording medium 1. The protective film 11 is made of a crystalline glass. A pulsed current is provided to the resistor member 10 so as to heat an outer surface of the protective film 11 to a predetermined constant temperature. The visible image recorded on the display area 1*b* is erased by the heated surface of the protective film 11 of the thermal erasing head 6.

Referring to FIG. 4, an initial position detecting sensor 12 is provided posterior to the feed rollers 3 which are located near the recording medium insertion opening 8. Additionally, a reverse detecting sensor 13 is provided posterior to the thermal erasing head 6.

Figure 7:
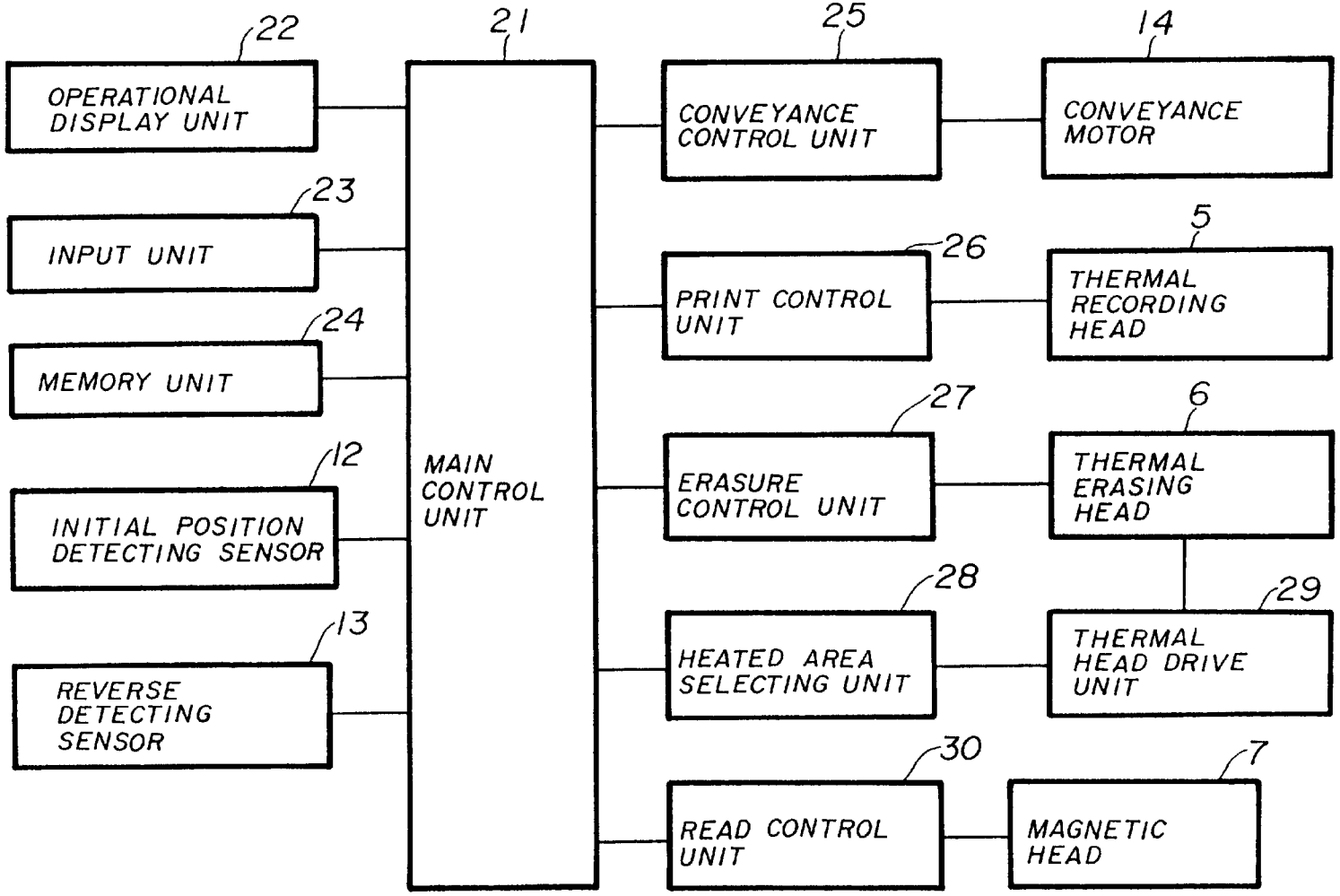
FIG. 7 is a block diagram of a control unit of the recording apparatus shown in FIG. 4.

FIG. 7 is a block diagram of a control unit of the recording apparatus shown in FIG. 4. The control unit of the recording apparatus according to the present embodiment comprises a main control unit 21, an operational display unit 22, an input unit 23, a memory unit 24, a conveyance control unit 25, a print control unit 26, an erasure control unit 27, a heated area selecting unit 28, a heating head drive unit 29 and a read control unit 30. The main control unit 21 controls operations of the entire recording apparatus. The operational display unit 22 instructs a recording operation and an erasing operation performed on the reversible heat-sensitive recording medium 1, and instructs the display area 1*b* and displays an operational state of the recording apparatus 2. The input unit 23 inputs information which is to be recorded on the reversible heat-sensitive recording medium 1, and stores the information in the memory unit 24. Information with respect to a range L1 of the display area 1*b* and ranges L2 and L3 of the printed area 1*a* of the reversible heat-sensitive recording medium 1 shown in FIG. 5 is previously stored in the memory unit 24. The conveyance control unit 25 drives a conveyance motor 14 which drives each of the feed rollers 3. The conveyance control unit 25 also controls normal and reverse rotations of the conveyance motor 14. The print control unit 26 controls a recording operation of the thermal recording head 5. The erasure control unit 27 controls a current provided to the thermal erasing head 6 so as to control a temperature of a surface of the thermal erasing head 6. The heated area selecting unit 28 selects a timing for contacting the thermal erasing head 6 to the reversible heat-sensitive recording medium 1 and a time range of the contact in accordance with the range and position of the display area 1*b* which is stored in the memory unit 24 or instructed through the operational display unit 22. The thermal head drive unit 29 moves the thermal erasing head 6 so that the thermal erasing head 6 contacts the reversible heat-sensitive recording medium 1 in accordance with the selected timing and time range by the heated area selecting unit 28 so as to heat the display area 1*b* of the reversible heat-sensitive recording medium 1. The read control unit 30 controls a reading operation performed by the magnetic head 7.

Figure 8:
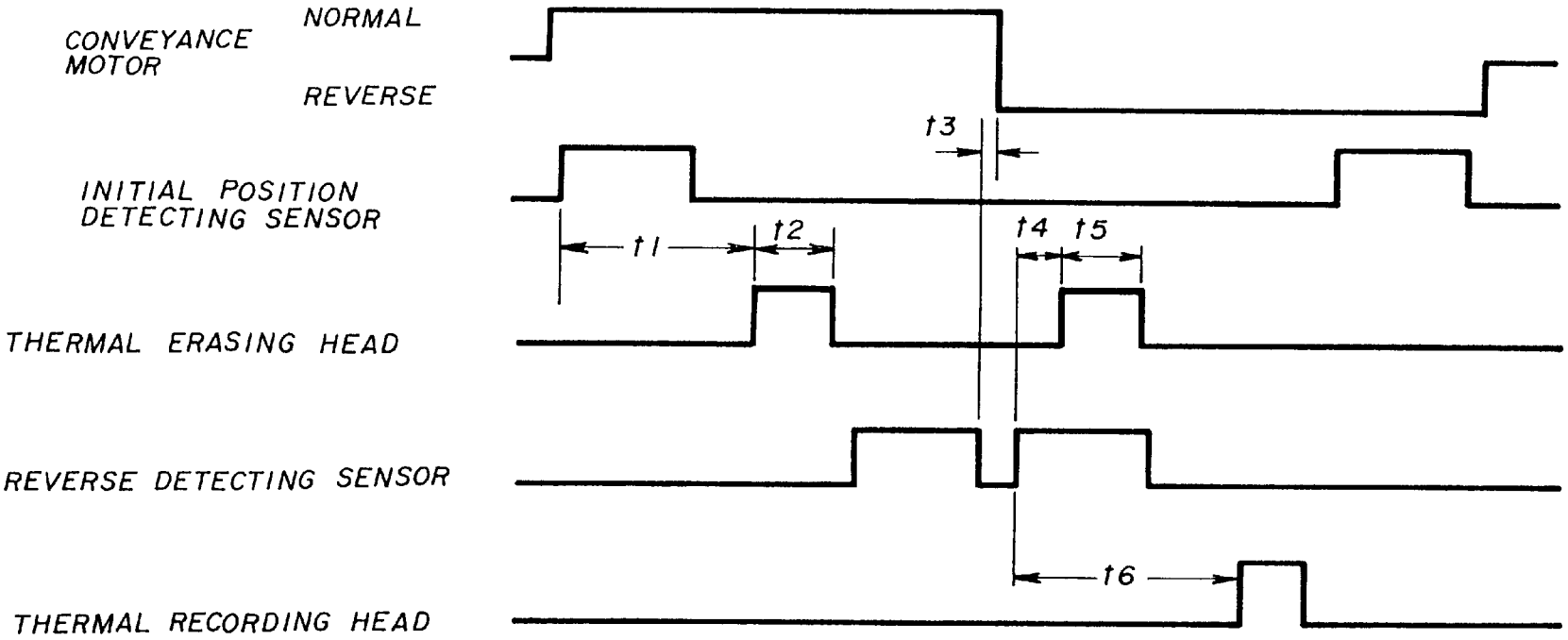
FIG. 8 is a time chart of an erasing operation and a recording operation performed by the recording apparatus shown in FIG. 4.

A description will now be given, with reference to FIG. 8, of an erasing operation and a subsequent recording operation performed by the recording apparatus 2. FIG. 8 is a time chart of the erasing operation and the recording operation performed by the recording apparatus 2.

When the reversible heat-sensitive recording medium 1 is inserted into the recording medium insertion opening 8 and a recording and erasure is instructed by the operational display unit 22, the main control unit 21 instructs the conveyance control unit 25 to convey the reversible heat-sensitive recording medium 1. The conveyance control unit 25 rotates the conveyance motor 14 at a constant speed in a normal direction when conveyance of the reversible heat-sensitive recording medium 1 is instructed. Accordingly, the feed rollers 3 are rotated by the rotation of the conveyance motor 14, and the reversible heat-sensitive recording medium 1 is conveyed along the thermal recording head 5, the thermal erasing head 6 and the magnetic head 7. Then, when a trailing edge of the reversible heat-sensitive recording medium 1 is detected by the reverse detection sensor 13, the conveyance control unit 25 rotates the conveyance motor 14 in a reverse direction at a predetermined timing t3. Thus, the feed rollers 3 are reversely rotated to convey the reversible heat-sensitive recording medium 1 toward the recording medium insertion opening 8. During the above-mentioned reciprocation of the reversible heat-sensitive recording medium 1, the display area 1*b* of the reversible heat-sensitive recording medium 1 is heated so as to erase the visible image on the display area 1*b* and record a new visible image by the thermal recording head 5.

When the conveyance of the reversible heat-sensitive recording medium 1 is started and the front end (leading edge) of the reversible heat-sensitive recording medium 1 is detected by the initial position detecting sensor 12, the erasure control unit 27 provides a current to the thermal erasing head 6 so as to heat the thermal erasing head 6 to a predetermined constant temperature. At the same time, the heated area selecting unit 28 calculates a distance (L+L2−L0), where L is a distance between the initial position detection sensor 12 and the thermal erasing head 6; L2 is a distance between the front end of the reversible heat-sensitive recording medium 1 and the display area 1*b;* and L0 is a predetermined length which is, for example, 5 mm in the present embodiment. Then, the heated area selecting unit 28 calculates a time t1 for a first half (forward direction) of the travel of the reversible heat-sensitive recording medium 1 based on the calculated distance (L+L2−L0) and a conveying speed V of the reversible heat-sensitive recording medium 1, where the time t1 is a period from the detection of the front end of the reversible heat-sensitive recording medium 1 to a start of heating the thermal erasing head. Further, the heated area selecting unit calculates a time t2 which is a period for heating the reversible heat-sensitive recording medium 1. The time t2 is calculated based on a length (L1+L0) which is a sum of the length L1 of the display area 1*b* and the predetermined length L1 and the conveying speed V of the reversible heat-sensitive recording medium 1. The information with respect to the time t1 and the time t2 is sent to the thermal head drive unit 29. The thermal head drive unit 29 moves the thermal erasing head 6 to contact the reversible heat-sensitive recording medium 1 when the time t1 is passed after the front end of the reversible heat-sensitive recording medium 1 is detected by the initial position detecting sensor 12 so that the reversible heat-sensitive recording medium 1 is pre-heated at a temperature near the temperature which provides a transparency. After the time t2 has passed since the thermal erasing head 6 contacts the reversible heat-sensitive recording medium 1, the thermal head drive unit 29 moves the thermal erasing head 6 to separate from the reversible heat-sensitive recording medium 1.

As mentioned above, since the thermal erasing head 6 contacts the reversible heat-sensitive recording medium 1 at a position in the printed area 1*a* the length L0 preceding the display area 1*b,* dirt adhering on the thermal erasing head 6 can be removed by the printed area 1*a* which has a relatively large surface roughness. Additionally, since the thermal erasing head 6 is separated from the reversible heat-sensitive recording medium 1 after the thermal erasing head 6 has contacted the printed area 1*a* for the predetermined length L0 after the display area 1*b* has passed the thermal erasing head 6, dirt which adhered on the thermal erasing head while the thermal erasing head is contacting and heating the display area 1*b* can also be removed.

When the rear end (trailing edge) of the preheated reversible heat-sensitive recording medium 1 is detected by the reverse detecting sensor 13, the direction of travel of the reversible heat-sensitive recording medium 1 is reversed. Thereafter, when the rear end of the reversible heat-sensitive recording medium 1 is detected again by the reverse detecting sensor 13 in returning, the heated area selecting unit 28 calculates a distance (LR+L3−L0), where LR is a distance between the reverse detecting sensor 13 and the thermal erasing head 6; L3 is a length between the trailing edge of the reversible heat-sensitive recording medium 1 and the display area 1*b*. Then, the heated area selecting unit 28 calculates a time t4 for a second half (reverse direction) of the travel of the reversible heat-sensitive recording medium 1 based on the calculated distance (LR+L3−L0) and a conveying speed V of the reversible heat-sensitive recording medium 1, where the time t4 is a period from the detection of the leading edge of the reversible heat-sensitive recording medium 1 to a start of heating the thermal erasing head. Additionally, the heated area selecting unit 29 calculates a time t5 which is a period for heating the reversible heat-sensitive recording medium 1. The time t5 is calculated based on a length (L1+L0) which is a sum of the length L1 of the display area 1*b* and the predetermined length L0 and the conveying speed V of the reversible heat-sensitive recording medium 1. The information with respect to the time t4 and the time t5 is sent to the thermal head drive unit 29. The thermal head drive unit 29 moves the thermal erasing head 6 to contact the reversible heat-sensitive recording medium 1 when the time t4 has passed after the rear end of the reversible heat-sensitive recording medium 1 is detected by the reverse detecting sensor 13 so that the reversible heat-sensitive recording medium 1 is heated at the temperature which provides a transparency. After the time t5 has passed after the thermal erasing head 6 contacts the reversible heat-sensitive recording medium 1, the thermal head drive unit 29 moves the thermal erasing head 6 to separate from the reversible heat-sensitive recording medium 1.

As mentioned above, since the display area 1*b* of the reversible heat-sensitive recording medium 1 is heated at the temperature which provides transparency after the display area 1*b* is pre-heated by the thermal erasing head 6, a visible image recorded on the display area 1*b* can be positively erased.

Additionally, when the rear end (leading edge) of the reversible heat-sensitive recording medium 1 is detected by the reverse detecting sensor 13 after the movement of the reversible heat-sensitive recording medium 1 is reversed, the print control unit 26 starts a recording operation of the thermal recording head 5 after a time t6 has passed after the rear end was detected. Accordingly, a new visible image is recorded on the display area 1*b* of the reversible heat-sensitive recording medium 1. Thereafter, the reversible heat-sensitive recording medium 1 on which the new visible image is recorded is ejected from the recording medium insertion opening 8, and the erasing and recording operation is ended.

A description will now be given of the result of experiments performed by using the recording apparatus 2 according to the present embodiment. In the experiments, the number of erasing operations performed before a first incomplete erasure occurred was investigated by varying the length L0 which is a length along which the thermal erasing head 6 contacts the printed area 1*a* of the reversible heat-sensitive recording medium 1. The following Table 1 shows the result of the experiments.

TABLE 1

| Sample | Length LO (mm) Upstream | Length LO (mm) Downstream | Number of erasing operations |
|---|---|---|---|
| A | 0 | 0 | 10 |
| B | 5 | 0 | 55 |
| C | 5 | 5 | 102 |
| D | 15 | 15 | 222 |

As appreciated from the Table 1, when the thermal erasing head 6 contacted only the display area 1*b* of the reversible heat-sensitive recording medium 1, a first incomplete erasure occurred when the erasing operation was repeated only ten (10) times. This is because dirt adhered on the thermal erasing head 6 during repetition of the erasing operation and, thus, heat resistance between the thermal erasing head 6 and the reversible heat-sensitive recording medium 1 was increased. Additionally, when the thermal erasing head 6 contacted the printed area 1*a* which precedes the display area 1*a* (on the upstream side) by a length of 5 mm, a first incomplete erasure occurred when the erasing operation was repeated fifty-five (55) times. Further, when the thermal erasing head 6 contacted the printed area 1*a* on both sides of the display area 1*a* (both on the upstream side and the downstream side) by a length of 5 mm, a first incomplete erasure occurred when the erasing operation was repeated one hundred and two (102) times. Further, when the thermal erasing head 6 was made in contact with the printed area 1*a* on both sides of the display area 1*a* (both on the upstream side and the downstream side) by a length of 15 mm, a first incomplete erasure occurred when the erasing operation was repeated two hundreds and twenty-two (222) times. The above-mentioned result indicates that the erasing operation can be repeated about fifty (50) times without cleaning the thermal erasing head 6 when the thermal erasing head 6 is in contact with the printed area la for at least 5 mm. Additionally, the number of erasing operations in which a visible image is positively erased can be increased by increasing the range of the length along which the thermal erasing head 6 contacts the printed area 1*a*.

Additionally, the number of erasing operations in which a visible image can be positively erased was dependent on a surface roughness of the printed area 1*a*. That is, an efficiency of removal of dirt is decreased when the maximum height in the surface roughness is small, whereas the efficiency of removal of dirt is increased when the maximum height in the surface roughness is large. However, if the maximum height is increased too much, coefficient of friction between the printed area 1*a* and the thermal erasing head 6 or the thermal recording head 5 is increased which results in surface abrasion of the thermal erasing head 6 or the thermal recording head 5. Additionally, the surface of the printed area 1*a* is also scraped which results in production of dust. In order to prevent such problems, an optimum efficiency was obtained when the surface roughness of the printed area 1*a* was set within a range from 2 $\mu mR_{max}$ to 15 $\mu mR_{max}$ which was greater than the surface roughness of the display area 1*b* which was 0.8 $\mu mR_{max}$.

It should be noted that the present invention can also be applied to a recording apparatus in which the thermal erasing head 6 is located on the upstream side of the thermal recording head 5 and the reversible heat-sensitive recording medium 1 is moved in one way.

Additionally, although, in the above-mentioned embodiment, the thermal erasing head 6 is heated at the same temperature irrespective of whether the thermal erasing head 6 is in contact with the display area 1*b* or the printed area 1*a*, the temperature when the thermal erasing head 6 is in contact with the printed area 1*a* may be less than the temperature when the thermal erasing head 6 is in contact with the display area 1*b* so as to prevent adherence of dirt and facilitate removal of dirt.

In the above-mentioned embodiment, the thermal erasing head 6 contacts the printed are 1*a* which is an area provided with a print. However, the printed area is not always provided with a print, and any area other than the display area 1*b* can be used as an area to be contacted by the thermal erasing head 6 to remove dirt adhering thereon.

Additionally, although the present invention is related the recording apparatus, the present invention may be applied to an erasing apparatus which simply erase a visible image recorded on the reversible heat-sensitive recording medium 1.

The present invention is not limited to the specifically disclosed embodiments, and variations and modifications may be made without departing from the scope of the present invention.

What is claimed is:

1. A recording method for repeatedly recording and erasing a visible image on a reversible heat-sensitive recording medium, said recording medium comprising a display area on which the visible image is recorded by a thermal recording head and a non-display area other than said display area, the visible image being erased by providing heat generated by a thermal erasing head, said recording method comprising the steps of:

a) contacting said thermal erasing head to said non-display area before said thermal erasing head contacts said display area;

b) contacting said thermal erasing head to said display area so as to erase the visible image; and c) recording a new visible image on said display area by said thermal recording head.

2. The recording method as claimed in claim 1, further comprising the step of:

d) contacting said thermal erasing head to non-display area subsequent to said contact of said thermal erasing head with said display area in step b).

3. The recording method as claimed in claim 2, further comprising the step of:

e) continuously contacting said recording medium with said thermal erasing head while the process of steps a), b) and d) is performed.

4. The recording method as claimed in claim 1, further comprising the step of:

f) maintaining a temperature of said thermal erasing head when the thermal erasing head is in contact with said non-display area to be less than a temperature of said thermal erasing head when the thermal erasing head is in contact with said display area.

5. The recording method as claimed in claim 1, further comprising the step of:

g) providing a maximum height of a surface roughness of said non-display area to be in a range from about 2 $\mu$m to about 15 $\mu$m.

6. A recording apparatus for repeatedly recording and erasing a visible image on a reversible heat-sensitive recording medium, said recording medium comprising a display area on which the visible image is recorded and a non-display area other than said display area, said recording apparatus comprising:

a thermal recording head for recording the visible image on said display area;

a thermal erasing head for erasing the visible image recorded on said display area by providing heat to said display area;

a thermal head drive unit for moving said thermal erasing head relative to said reversible heat-sensitive recording medium so that said thermal erasing head is moved to one of a contact position in which said thermal erasing head contacts said reversible heat-sensitive recording medium and a non-contact position in which said thermal erasing head is separated from said reversible heat-sensitive recording medium; and a heated area selecting unit for determining a timing of movement of said thermal erasing head to one of said contact position and said non-contact position so as to select a range in which said thermal erasing head contacts said reversible heat-sensitive recording medium, a timing for moving said thermal erasing head to said reversible heat-sensitive recording medium being determined so that said thermal erasing head contacts said non-contact area before said thermal erasing head contacts said display area.

7. The recording apparatus as claimed in claim 6, wherein said heated area selecting unit determines said range so that said thermal erasing head contacts said non-display area for at least 5 mm before said thermal erasing head contacts said display area.

8. The recording apparatus as claimed in claim 7, wherein said heated area selecting unit determines said range so that said thermal erasing head contacts said non-display area for at least 5 mm after said thermal erasing head contacts said display area.

9. An erasing method for repeatedly erasing a visible image on a reversible heat-sensitive recording medium, said recording medium comprising a display area on which the visible image is recorded and a non-display area other than said display area, the visible image being erased by providing heat for a thermal erasing head, said erasing method comprising the steps of:

a) contacting said thermal erasing head to said non-display area before said thermal erasing head contacts said display area; and b) contacting said thermal erasing head to said display area so as to erase the visible image.

10. The erasing method as claimed in claim 9, further comprising the step of:

c) contacting said thermal erasing head to said non-display area after said thermal erasing head contacts said display area to erase the visible image.

11. An erasing apparatus for repeatedly erasing a visible image on a reversible heat-sensitive recording medium, said recording medium comprising a display area on which the visible image is recorded and a non-display area other than said display area, said erasing apparatus comprising:

a thermal erasing head for erasing the visible image recorded on said display area by providing heat to said display area;

a thermal head drive unit for moving said thermal erasing head relative to said reversible heat-sensitive recording medium so that said thermal erasing head is moved to one of a contact position in which said thermal erasing head contacts said reversible heat-sensitive recording medium and a non-contact position in which said thermal erasing head is separated from said reversible heat-sensitive recording medium; and a heated area selecting unit for determining a timing of movement of said thermal erasing head to one of said contact position and said non-contact position so as to select a range in which said thermal erasing head contacts said reversible heat-sensitive recording medium, a timing for moving said thermal erasing head to said reversible heat-sensitive recording medium being determined so that said thermal erasing head contacts said non-contact area before said thermal erasing head contacts said display area.

12. The erasing apparatus as claimed in claim 11, wherein said heated area selecting unit determines said range so that said thermal erasing head contacts said non-display area for at least 5 mm before said thermal erasing head contacts said display area.

13. The erasing apparatus as claimed in claim 11, wherein said heated area selecting unit determines said range so that said thermal erasing head contacts said non-display area for at least 5 mm after said thermal erasing head contacts said display area.

14. The recording method as claimed in claim 1, wherein the nondisplay area has a surface roughness higher than a surface roughness of said display area.

15. A recording apparatus as claimed in claim 6, wherein said nondisplay area has a surface roughness greater than a surface roughness of said display area.

16. The erasing method as claimed in claim 9, wherein said nondisplay area has a surface roughness greater than a surface roughness of said display area.

17. The erasing apparatus as claimed in claim 11, wherein said nondisplay area has a surface roughness greater than a surface roughness of said display area.

* * * * *